US011213724B2

(12) United States Patent
Amundsen

(10) Patent No.: US 11,213,724 B2
(45) **Date of Patent: *Jan. 4, 2022**

(54) OFFSET GOLF CLUB HEAD

(71) Applicant: William L. Amundsen, Frisco, TX (US)

(72) Inventor: William L. Amundsen, Frisco, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/548,760

(22) Filed: Aug. 22, 2019

(65) Prior Publication Data

US 2019/0381369 A1 Dec. 19, 2019

Related U.S. Application Data

(62) Division of application No. 15/897,329, filed on Feb. 15, 2018, now Pat. No. 10,493,330.

(51) Int. Cl.

| | |
|---|---|
| ***A63B 53/02*** | (2015.01) |
| ***A63B 53/00*** | (2015.01) |
| ***A63B 53/04*** | (2015.01) |
| ***A63B 60/40*** | (2015.01) |
| ***A63B 60/02*** | (2015.01) |
| *A63B 102/32* | (2015.01) |

(52) U.S. Cl.

CPC ..... *A63B 53/02* (2013.01); *A63B 53/007* (2013.01); *A63B 53/04* (2013.01); *A63B 53/0466* (2013.01); *A63B 53/0487* (2013.01); *A63B 60/02* (2015.10); *A63B 60/40* (2015.10); *A63B 2053/0491* (2013.01); *A63B 2102/32* (2015.10)

(58) Field of Classification Search

CPC . A63B 53/02; A63B 53/0487; A63B 53/0466; A63B 53/04; A63B 60/02; A63B 53/007; A63B 60/40; A63B 2053/0491; A63B 2102/32

See application file for complete search history.

(56) References Cited

U.S. PATENT DOCUMENTS 1,250,296 A * 12/1917 Stanton ..... A63B 53/0487 473/313
1,657,972 A * 1/1928 Rowe ..... A63B 53/065 473/248
3,815,910 A * 6/1974 Raines ..... A63B 53/007 473/313
3,989,257 A * 11/1976 Barr ..... A63B 53/0487 473/251
4,390,184 A * 6/1983 Rudell ..... A63B 53/0487 473/253

(Continued)

OTHER PUBLICATIONS

Library of Congress Title: [Alexander Graham Bell (right) and his assistants observing the progress of one of his tetrahedral kites] Reproduction No. LC-DIG-ppmsca-51814 (digital file from original) LC-G9-Z1-116,451-A (b&w film copy neg.) Call No. LOT 11533-10-26, No. 7 [P&P] Published: Jul. 7, 1908.*

*Primary Examiner* — Stephen L Blau

(74) *Attorney, Agent, or Firm* — Meroni & Meroni, PC; Charles F. Meroni, Jr.

(57) ABSTRACT

A golf club head or golf club, the club including a shaft, a body, a front face, a back face, and a connecting member. The connecting member attached to the center of the back face and extending away from the back face of the club head and turning at an angle, and wherein the front face of the clubhead forms a rectangular shape.

4 Claims, 4 Drawing Sheets

(56) References Cited

U.S. PATENT DOCUMENTS 5,160,141 A * 11/1992 Crews ..... A63B 53/02 473/313
5,253,869 A * 10/1993 Dingle ..... A63B 53/02 473/245
D344,315 S * 2/1994 Kelley ..... D21/741
5,340,104 A * 8/1994 Griffin ..... A63B 53/02 473/340
5,382,019 A * 1/1995 Sneed ..... A63B 53/02 473/304
5,462,279 A * 10/1995 Culpepper ..... A63B 53/065 473/248
5,695,410 A * 12/1997 Brown ..... A63B 60/00 473/305
5,700,207 A * 12/1997 Guthrie ..... A63B 53/0487 473/313
5,709,613 A * 1/1998 Sheraw ..... A63B 53/02 473/248
5,720,672 A * 2/1998 Smith ..... A63B 53/02 473/314
5,795,246 A * 8/1998 Hale ..... A63B 53/0487 473/340
6,435,976 B1 * 8/2002 Galliers ..... A63B 53/02 473/244
6,497,626 B1 * 12/2002 Sundberg ..... A63B 53/007 473/248
6,514,153 B2 * 2/2003 Miyamoto ..... A63B 60/00 473/305
7,806,778 B2 * 10/2010 Elmer ..... A63B 53/065 473/246
7,963,858 B2 * 6/2011 Sanderson ..... A63B 53/02 473/314
2006/0264264 A1 * 11/2006 Sandino ..... A63B 53/02 473/248
2007/0042831 A1 * 2/2007 Haines ..... A63B 53/02 473/313
2012/0058837 A1 * 3/2012 Riddle ..... A63B 53/007 473/329
2013/0053166 A1 * 2/2013 Tobian ..... A63B 53/007 473/307
2017/0189782 A1 * 7/2017 Jones ..... A63B 69/3661

* cited by examiner

OFFSET GOLF CLUB HEAD

This application claims the benefit of provisional application No. 62/459,365 filed Feb. 15, 2017. This application is a divisional application of application Ser. No. 15/897,329 filed Jun. 20, 2017.

FIELD OF THE INVENTION

The present invention generally relates to golf clubs used both recreationally and professionally. In particular, the current invention represents an improved design for club heads.

BACKGROUND

Golf is a well-known competitive sport and improvements in golf club and golf ball technology represent a fascination among both professionals and hobbyists. Indeed, golf is considered a difficult and competitive sport/hobby for many people. Many proposals have been made to design golf clubs which provide improved control over, and feel for, the golf ball, for example by providing grooves on the impact face of the golf club head. When your average golfer swings a golf club, he or she may have dramatic variations in his or her golf swing, resulting in numerous off-center hits, which result in diminished performance when compared to a direct center hit. However, in an attempt to make this very difficult game more enjoyable for the average golfer, golf club designers have come up with unique golf club designs that will mitigate the harsh realities of a less than perfect golf swing.

Despite all of the attempts to improve the performance of a golf club head all while trying to minimize the sacrifice in feel of a golf club, the predominant designs of golf clubs and club heads do not transmit maximum force through the head of the golfer's swing to the ball. Other patents have attempted to solve the ideal golf club design, but predominantly have failed to deliver every promised feature at once.

U.S. Pat. No. 723,534 ('534 Patent), issued to Knight, describes a golf club in which the center of the shaft is connected to the head forward of the center mass in the direction of delivery of the blow and at a point between the heel and toe of the club-head. It comprises also a head having a striking face along its major axis, with the shaft connection at a point forward of the center of mass.

U.S. Pat. No. 4,330,128 ('128 Patent), issued to Morelli, describes a golf putter having, in combination, a putting head and an elongate article, such as a bottle, a portion of which constitutes the putting surface. The putter comprises a generally flat, vertically oriented driving element attached to the putter shaft, with an aperture formed in the driving element of sufficient dimension to accept the elongate article. A receptor, spaced from the driving element by an arm extending between the receptor and the driving element, is shaped to engage one end of the elongate article and retain the article with part of the article being situated within the aperture. That portion of the elongate article extending from the aperture on the side of the driving element opposite from the receptor constitutes the putting surface.

U.S. Pat. No. 6,383,089 ('089 Patent), submitted by Bonne au, describes a putter head fashioned from a block metal having a conventional face, but having a mass relieved portion behind the face, with greatest mass relief at the sole of the club and a lesser amount of mass relief extending upwardly to the top surface of the club which has conventional dimensions and shape. Since the greatest amount of mass relief is at the bottom of the club, the mass relief is said to be inverted. A pair of inclined ribs behind the central portion of the face add stiffness to the club. The club has a raised center of gravity intended to be in alignment with the center of a golf ball. A plug of heavy metal may be centered on the center of gravity to add stiffness at the zone. Although the club would typically be made out of aluminum or steel, a club, without the plug, could be made of an ultra-heavy metal, such as depleted uranium, and be no heavier than a regular club due to the inverted mass relief.

U.S. Pat. No. 8,480,515 ('515 Patent), which issued to Roach et el., describes a golf club head having a translucent insert disclosed. The club head includes a body defining a striking face, a top line, a sole, a back, a heel, and a toe. The back contains a cavity that extends in a direction substantially perpendicular to the face. A recess is provided within the cavity, with the recess extending away from the cavity and toward the sole. A translucent insert, such as a vibration dampening member, may be provided within the recess. The insert may contain secondary inserts, such as weight members, therein in strategic locations. The insert may completely fill the recess, or may fill only a portion thereof.

United States Patent Application No. 2011/0014992, submitted by Morrissey, describes a golf club which includes a head and a shaft coupled to the head. The shaft is positioned so that an axis of the shaft intersect at or near a center of mass of the head.

These problems, and others, have been addressed by the improved golf club heads disclosed herein and discussed in greater detail below.

BRIEF SUMMARY

Thus, to solve such problems and others, it is proposed to re-design the connection of the shaft to the golf club head, connecting the shaft to the rear of the golf club head. This then will afford the maximum force of the golfer's swing to the golf club head resulting in greater flight distance of the golf ball with little or no deflection of the golf club head or twisting of the golf club shaft causing the ball to fly in errant directions.

This is to be contrasted with most current designs that allow significant deflection of the club head and twisting of the shaft (which is essentially a hollow tube) which contribute to a loss of distance that the ball flies.

Another benefit that can be afforded in the present design is that the clubhead/shaft connection will allow for a golf club head that is a full rectangular shape rather than the currently used tear drop shape. This rectangular shape provides a larger striking area that has a concentrated center point of force, rather than an off-center, remote point of force.

Manufacturing of such club heads could continue using the casting methods traditionally used by current manufacturers. However, the shaft would instead be centered to the rear of the golf club head. This would also allow the casting of the golf club head and stem connection to the shaft at the same time. This can result in a stronger continuity of materials rather than connecting the stem to the golf club head in a second operation. Varying degrees of angle for the club head to the golfer's hands can be designed into the molds.

The advantages of such an application become clear when one is experienced with golf clubs, or golf club manufacturing. Typical devices currently on the market do not have the confluence and plethora of features contemplated and described herein.

In a first embodiment the disclosure contemplates a golf club including a shaft; and a clubhead, the clubhead having a body, a front face, and a back face, the shaft connected to the clubhead at the center of the back face by a connecting member, the connecting member extending away from the back face of the clubhead and turning to connect to the shaft; and wherein the front face of the clubhead forms a rectangular shape.

In another embodiment the disclosure contemplates a golf club head including a body, a front face, a back face, and a connecting member; the connecting member attached to the center of the back face and extending away from the back face of the club head and turning at an angle; and wherein the front face of the clubhead forms a rectangular shape.

In another embodiment the disclosure contemplates a golf club, including a shaft; and a body including: a ball striking face; a back face defined in the body at a location behind the ball striking face; a connection point extending in a direction away from the back face, wherein the connection point is connected to the center of mass of the body; wherein the connection point turns upwards and connects to the shaft; the striking face adapted for striking a ball.

Such embodiments do not represent the full scope of the invention. Reference is made therefore to the claims herein for interpreting the full scope of the invention. Other objects of the present invention, as well as particular features, elements, and advantages thereof, will be elucidated or become apparent from, the following description and the accompanying drawing figures.

DESCRIPTION OF THE DRAWINGS

The present invention may be better understood, and its numerous objects, features, and advantages made apparent to those skilled in the art by referencing the accompanying drawings.

DETAILED DESCRIPTION

Referring now the drawings with more specificity, the present invention essentially provides an improved golf club and golf club heads. The preferred embodiments of the present invention will now be described with reference to FIGS. 1-11 of the drawings. Variations and embodiments contained herein will become apparent in light of the following descriptions.

Figure 1:
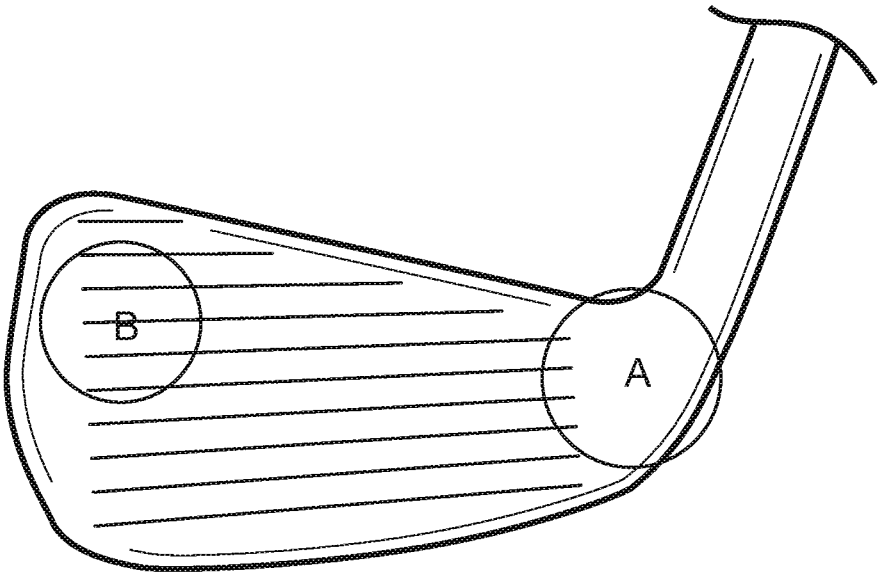
FIG. 1 is a front view of a club head and connection of the golf club head to the shaft.
Figure 2:
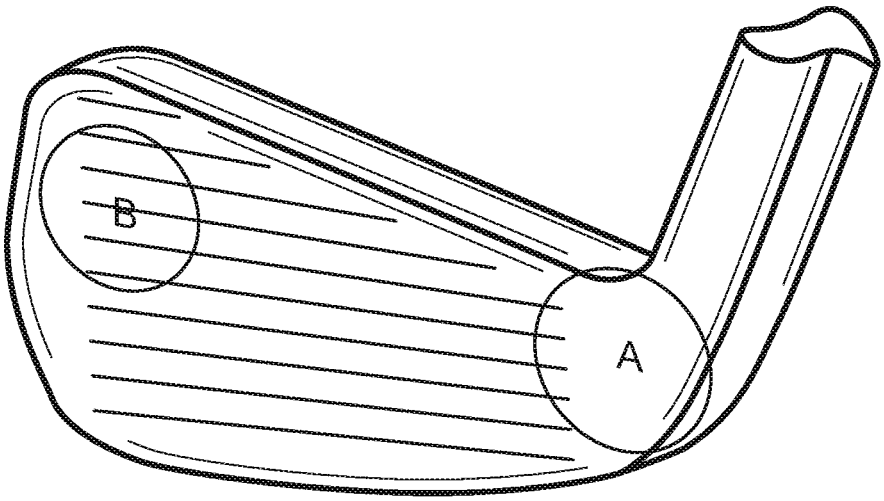
FIG. 2 is an angled view of the club head of FIG. 1.

Looking now to FIGS. 1 & 2 a more traditional form of golf club is depicted. In most instances as a golfer addresses the golf ball, his endeavor is to locate the strike zone of the club head and golf ball as close to the bulge of the club shaft connection as possible in order to gain as much benefit if the golfer's swing as possible. Any slight modification of the golfer's swing will result in the golf ball striking the club shaft mounting as (at circles "A") or striking the ball at the flag end of the club head (circles "B"). Striking the golf ball at either circle "A" or circle "B" will result in ball flight off-course of landing in a less desirable location. Striking the golf ball at circle "B", the flag end of the club head, causes off-course direction because the flag end of the club head is remote from the club shaft mount and the force of the gold ball strike causes the flag end, circle "B", to deflect thereby directing the ball flight off course to land in a less desirable location.

Figure 3:
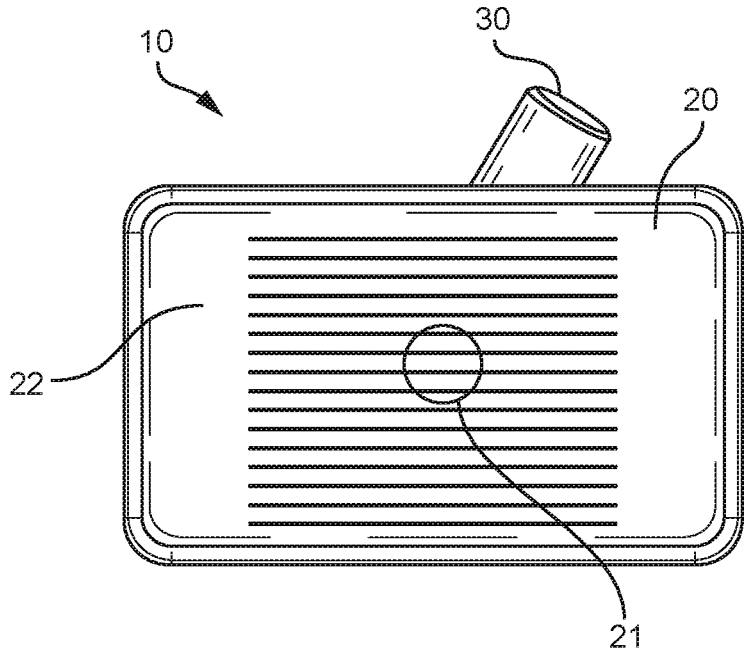
FIG. 3 is a front view of a rectangular golf club head as described in the present disclosure.

Turning now to FIGS. 3. & 4. A first embodiment of a club 10 according to the present disclosure is show. Club 10 is a replacement for traditional "irons" used by golfers. This club 10 connects clubhead 20 to shaft 30 at the center of the clubhead 21 at connection point 31. This results in the full power of the golfer's swing being transmitted directly to a golf ball resulting in a longer flight. Because this new design results in the clubhead (20) taking the shape of a rectangle as shown in FIG. 3 connecting the club shaft 30 to the center of the rear (at 31) of the clubhead 20, results in a club face 22 without any obstruction allowing the ball flight direction to be more in the control of the golfer. The top face 40 of the embodiment is contoured to improve performance, by shifting the center of mass and changing the total mass of the clubhead 20. This shape is substantially similar to a curved "E" as depicted with the club shaft passing between two of the "E'"s prongs.

Figure 5:
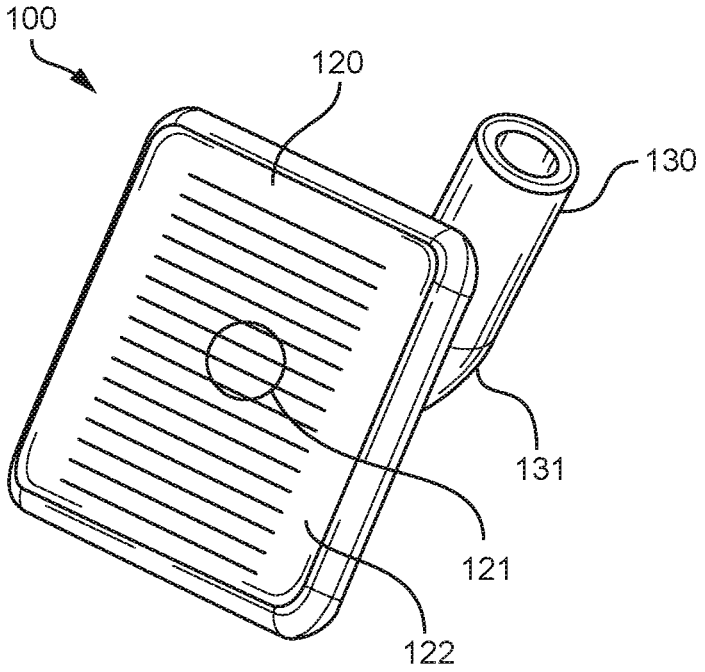
FIG. 5 is front perspective view of a second embodiment of a rectangular golf club head as described in the present disclosure.

Turning now to FIGS. 5. & 6. a second embodiment of a club 100, according to the present disclosure, is show. Club 100 is a similar to club 10 in that it also is a replacement for traditional "irons" used by golfers. This club 100 connects clubhead 120 to shaft 130 at the center of the clubhead 121 at connection point 131. This results in the full power of the golfer's swing being transmitted directly to a golf ball resulting in a longer flight. However, unlike in club 10 this new design results in the clubhead 120 taking the shape of a square as shown in FIG. 5 connecting the club shaft 130 to the center of the rear (at 131) of the clubhead 120, results in a club face 122 without any obstruction allowing the ball flight direction to be more in the control of the golfer. It should be noted that while club 10 is shown as a rectangle and club 100 as a square, both can be adapted to use either a square or rectangular clubface, depending on the desired performance of the club.

Figure 7:
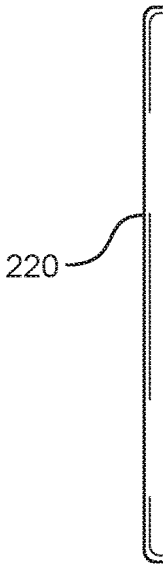
FIG. 7 is a is a cross-sectional view in a horizontal plane at about the center of the head of another embodiment of a golf club head according to this disclosure.
Figure 8:
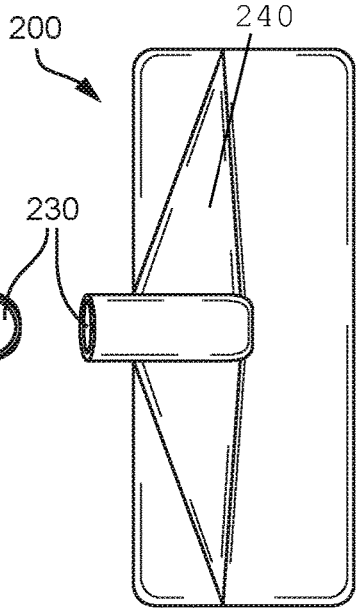
FIG. 8 is a back view of the club head of FIG. 7.
Figure 9:
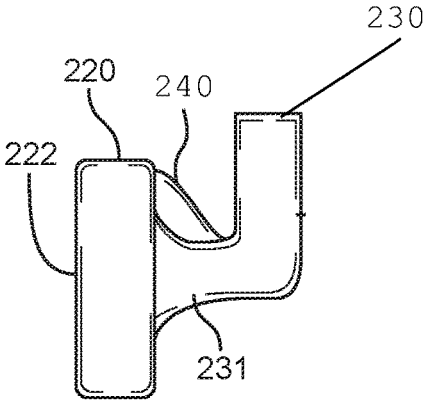
FIG. 9 is a cross sectional view of the golf club head of FIGS. 7 &8.

Turning now to FIGS. 7, 8, & 9. a club 200, according to the present disclosure, is show. Club 200 is a replacement for traditional "putters" used by golfers. This club 200 connects clubhead 220 to shaft 230 at the center of the clubhead 221 at connection point 231. In this application, it typically will provide greater control and stability when striking the ball compared to traditional putters. In this way clubface 222 is less likely to turn on impact unless so directed by the golfer. Club 200 is typically constructed as a rectangle, with supportive backing or weight assembly 240. Said weight assembly angles from the top of the backside of the clubhead 220 towards connection point 231 and forms a curved triangle from the topside view and a shape from the backside view (as seen in FIGS. 7 & 8).

Figure 10:
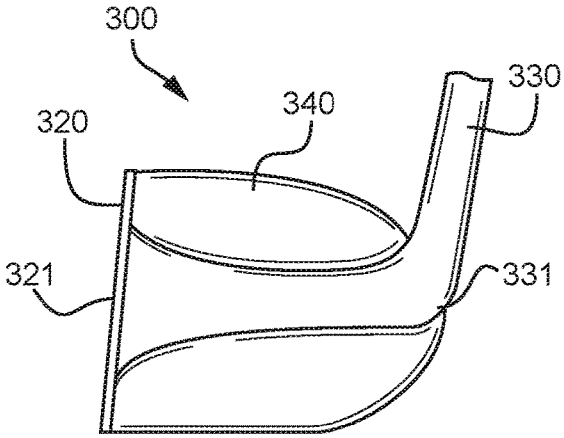
FIG. 10 is a side on, semi-transparent view of another embodiment of a gold club head according to the present disclosure.
Figure 11:
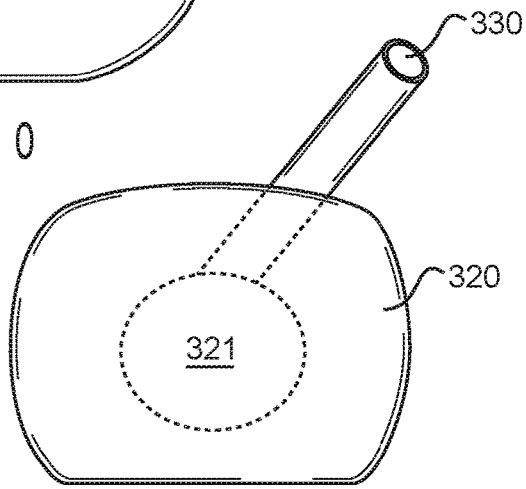
FIG. 11 is a front view of the golf club head of FIG. 10.

Turning finally to FIGS. 10 & 11. an embodiment of a club 300, according to the present disclosure, is show. Club 300 is a replacement for traditional "woods" used by golfers. This club 300 connects clubhead 320 to shaft 330 at the center of the clubhead 321 at connection point 3331. As with the "irons" presented above, this results in the full power of the golfer's swing being transmitted directly to a golf ball resulting in a longer flight, along with greater stability on impact. However, unlike in club 10 this new design results in the clubhead 120 being supported by additional support or weight assembly 340. The weight assembly 340 encompassing the connection point 331 at all sides and extending away from the back side towards the shaft 330. The club shaft 330 remains connected to the center of the rear (at 331) of the clubhead 320. It should be noted that while club 10 is shown as a rounded rectangle it can be adapted to both square and rectangle configurations.

Figure 4:
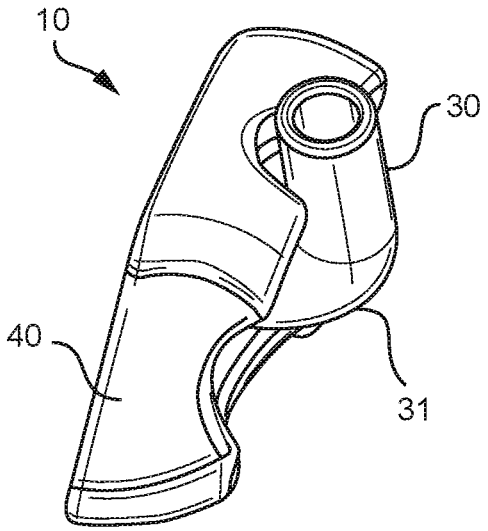
FIG. 4 is a top angled view of a golf club head of FIG. 3 as described in the present disclosure.
Figure 6:
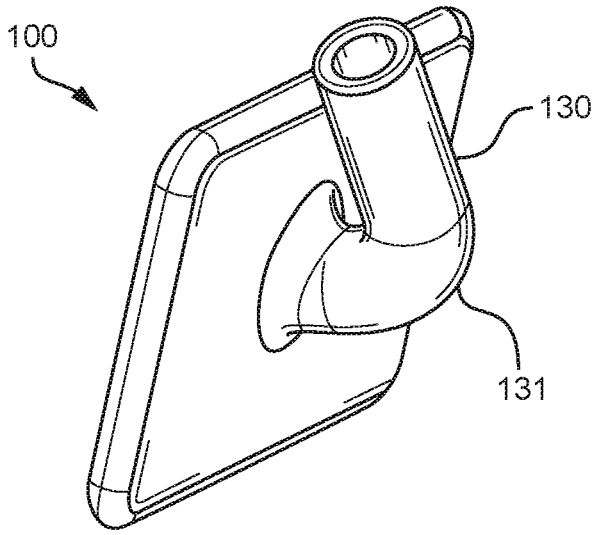
FIG. 6 is a back side perspective view of the golf club head of FIG. 5.

As shown in FIGS. 7-11 the connection point (231, 331) may be substantially tapered, or it may be more uniform in thickness as shown in FIGS. 4 & 6. Tapering of connection points can provide additional strength, but is not desirable in every application.

INDUSTRIAL APPLICABILITY

A review of the benefits of the novel golf clubs (10, 100, 200, 300) contained herein follows. 1. The full power of the golfer's swing is directed immediately to the golf ball contributing to additional yards of flight of the golf ball. 2. There is no change in the golfer's stance as he addresses the golf ball to drive, approach, chip or putt. 3. This new design of club head eliminates the two existing problems now a part of the tear shaped golf club, presently the only shaped golf club available.

The newly designed clubheads (20, 120, 230, 330) result in a flat faced club head which does not have a protrusion on one end near where the golf ball is struck or the end remote from the source of power of the golfer's swing, all affecting the direction of the golf ball flight head strike. Also, when a golf ball has landed in the "rough", the grasses are higher than the golf ball, to very high resulting in a very difficult shot. This hazard, the "rough", provides great resistance to current club designs. This resistance from the taller grasses causes the flag end of the golf club to retreat, thereby affecting the flight direction of the golf ball. However, this problem can be at least partially overcome by the greater force and stability provided by the clubs disclosed herein.

Accordingly, although the invention has been described by reference to certain preferred and alternative embodiments, it is not intended that the novel arrangements be limited thereby, but that modifications thereof are intended to be included as falling within the broad scope and spirit of the foregoing disclosures and the appended drawings.

I claim:

1. A golf club head comprising:

a body, a front face, a back face, and a connecting member;

the connecting member attached to the center of the back face and extending away from the back face of the club head and turning at an angle;

a weight assembly the weight assembly engulfing the connection member on at least three (3) sides on the back face of the clubhead; and wherein the connection member is tapered as it extends away from the back face of the club head.

2. The club head of claim 1 wherein:

wherein the front face of the clubhead forms a rectangular shape.

3. The golf club of claim 1 wherein:

the weight assembly forms a curved triangle from a topside view with said triangle's vertices being defined by edges of the back face of the clubhead and the connection member.

4. The golf club of claim 3 wherein:

the weight assembly when viewed from a side-on view is located on a top of the connecting member, but not on a bottom thereof.

* * * * *